United States Patent [19]

Bibler et al.

[11] Patent Number: 4,842,040

[45] Date of Patent: Jun. 27, 1989

[54] UNIFORM COOLING OF CAST STRIP

[75] Inventors: James R. Bibler; Richard A. Gleixner, both of Columbus, Ohio

[73] Assignee: Battelle Development Corporation, Columbus, Ohio

[21] Appl. No.: 230,623

[22] Filed: Aug. 10, 1988

[51] Int. Cl.[4] ..... B22D 11/06

[52] U.S. Cl. ..... 164/429; 164/443; 29/129.5

[58] Field of Search ..... 164/423, 427, 429, 463, 164/479, 443, 485; 165/89; 29/129.5

[56] References Cited

U.S. PATENT DOCUMENTS 4,489,772 12/1984 McLane ..... 164/429

4,671,340 6/1987 Larrecq et al. ..... 164/429

*Primary Examiner*—Richard K. Seidel

*Attorney, Agent, or Firm*—Barry S. Bissell

[57] ABSTRACT

Metal strip 9 cast directly from the melt onto a cylindrical casting drum 20 is made more uniform in thickness and in structure by making the temperature of the casting surface more uniform. This is accomplished by a novel arrangement of coolant channels 25 beneath the casting surface 10. The channels generally run circumferentially around the casting surface 10, parallel to and spaced from adjacent channels. At least one coolant inlet 21 and one coolant outlet 22 supply and withdraw coolant to each channel. Inlets (21*a,* 21*b*) and outlets (22*a* and 22*b*) of adjacent channels are staggered circumferentially from the inlets and outlets of the adjacent channels so that the cooler regions around inlets are staggered to balance the temperature across and around the surface.

13 Claims, 2 Drawing Sheets

(SECTION A-A)

(SECTION B-B)

UNIFORM COOLING OF CAST STRIP

TECHNICAL FIELD OF THE INVENTION

The invention relates to casting of metal products, particularly strip material, from a molten mass of the metal. Typically, a chilled casting drum is utilized to cast strip. A thin layer of molten metal is introduced to the chill surface and the latent heat of the melt flows radially into the wheel. The melt solidifies, adheres for a short time and then is released from the drum surface. The thickness of the strip as well as the microstructure are highly dependent on the cooling rate of the melt.

High rates of heat transfer to the chill surface are only possible when the strip is in close intimate contact with the surface. A greater amount of heat can be transferred during this time so that thicker, more uniform strip can be produced. We have demonstrated that the stresses induced by the thermal contraction of the solidifying metal causes the bond to rupture. A uniform temperature across the casting substrate will cause the thermal stresses to build up in a more uniform fashion so that the bond is not ruptured in a localized area resulting in either nonuniform growth or microstructure in this local area of the strip.

Prior methods of cooling casting drums have attempted to utilize cooling channels in various patterns under the casting surface. The present invention used circumferential paths which take advantage of the centrifugal forces generated by the rotation of the drum to force the coolant into intimate contact with the casting surface. This contact is necessary to mitigate the possible deleterious effects of air bubbles, air pockets, areas of nonuniform flow, etc. and thereby increasing the cooling efficiency.

SUMMARY OF THE INVENTION

The invention comprises a liquid-cooled substrate for casting uniform metal products directly from the melt comprising a cylindrical body having an outer circumferential casting surface and a plurality of coolant channels below the casting surface extending substantially circumferentially around the body and having at least one coolant inlet and one coolant outlet communicating with each coolant channel and also having supply passages communicating the inlets with a coolant source and return passages communicating the outlets with a coolant dump, wherein the inlets and outlets of each coolant channel are staggered circumferentially from the inlets and outlets, respectively, of each adjacent coolant channel.

The substrate may comprise a cylindrical core body and a separate annular casting shell which fits over the core body. The coolant channels may then comprise machined grooves in the casting shell enclosed by the outer surface of the core body or machined grooves in the outer surface of the core body enclosed by the inside surface of the casting shell.

The coolant source may be a reservoir located around the axle on one side of the core and the coolant dump may be a reservoir around the axle of the other side of the core or the reservoirs may be on the same side of the core. Each coolant channel may extend continuously around the entire circumference of the core and may communicate with more than one inlet and more than one outlet around the circumference. More preferably, each coolant channel does not extend continuously around the entire circumference of the core, but rather several channels, eg. four, are arranged end to end around the entire circumference. Each coolant channel may then communicate at one end thereof with one inlet and at the other end thereof with one outlet.

Each inlet is preferably staggered from the inlet of each adjacent cooling channel by at least about 5° angular separation. Preferably, each outlet is also staggered from the outlet of each adjacent coolant channel by at least about 5° angular separation. When four end-to-end channels extend around the circumference, it is preferred that the inlets and outlets of the adjacent channels be staggered by 45° so that each inlet, for example, falls adjacent the midpoint between the inlet and outlet of the adjacent channel. This results in a so-called ABAB pattern of channels across the core where every other channel has the same inlet/outlet angular position.

DESCRIPTION OF THE PREFERRED EMBODIMENTS

The invention is an apparatus for casting of metal products from the melt. It comprises apparatus for uniformly cooling the casting surface and is, therefore, particularly useful for casting wide strip material. The thickness and microstructure are particularly dependent on the substrate temperature. Any nonuniformity will impose thickness and structural variation in the strip. Since one of the primary objects of direct cast strip is to cast net shape and near-net shape products, the nonuniformity is to be avoided. Nonuniform temperature can also casue differential expansion of the casting surface and substructure leading to an undulation in the surface. This can cause nonuniform thickness in the cast products, especially when a second roller is used in the process to flatten the upper surface on the cast product.

Figure 1:
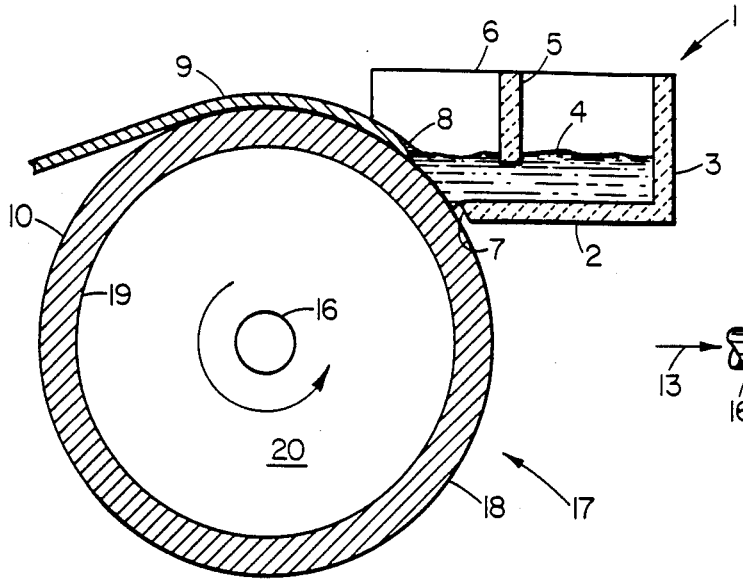
FIGS. 1 and 2 show a cross-sectional, side elevation view and a top view of existing apparatus for melt drag or open tundish casing of metal sheet.
Figure 2:
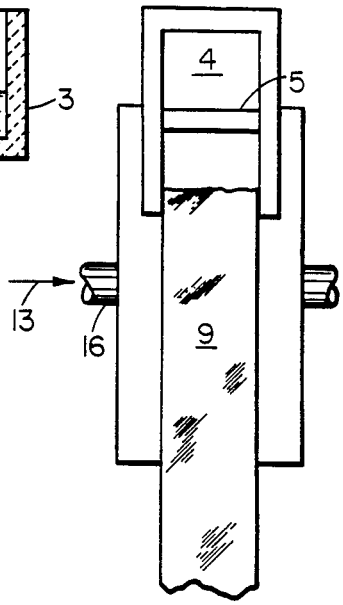

There are several process for introducing a layer of melt onto a chill substrate to make strip. One method known as the melt drag process is shown in FIG. 1 and FIG. 2. A cylindrical substrate 17 is made up of a cylindrical core body 20 surrounded by an annular shell 18. The shell has an outer cylindrical casting surface 10 and an inner cylindrical surface 19 in contact with the core. The substrate 17 is rotated about an axle 16 while the casting surface 10 passes through a pool of molten metal 4 in an open tundish 1.

The open tundish 1 has a bottom 2, backwall 3 and sidewalls 6. The front surface 7 of the bottom and sidewalls adjacent the casting surface 10 are contoured to match the shape of the casting surface. A weir 5 helps to control the metal depth and turbulance. As the casting surface passes through the melt pool, a liquid layer 8 is delivered to the surface 10 where it solidifies to strip 9. The thickness depends on several parameters including the depth of the melt pool and the temperature of the casting surface. The casting surface is cooled by circulation of a coolant through cooling channels in the substrate. The coolant typically enters at 13 through connections in the axle. Water is the preferred coolant.

Figure 3:
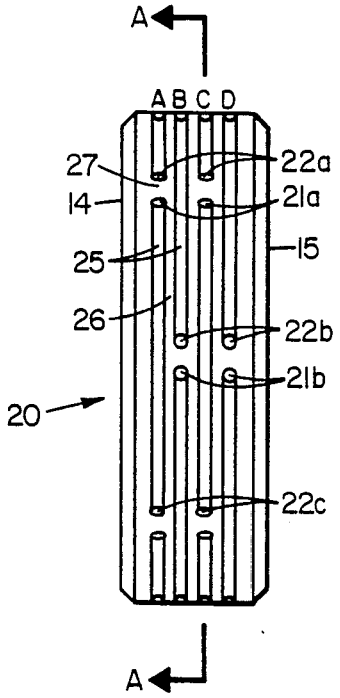
FIG. 3 is a plan view of a cylindrical core body used in the inventive liquid-cooled substrate.
Figure 6:
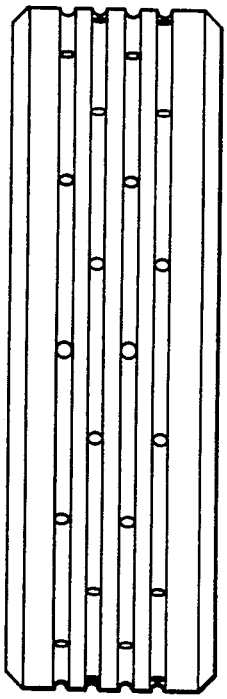
FIG. 6 shows an alternative coolant channel configuration for the core body according to the invention.

It has been discovered that extreme uniformity of surface temperatures is required to obtain a uniform metal strip. As shown in FIGS. 3 and 6, this is accomplished according to the invention by a system of staggered cooling channels. In FIG. 3, the core 20 is shown with cooling channels 25 machined circumferentially in the core outside surface 26. Four channel paths A,B,C and D are spaced across the surface 26 from side 14 to side 15 and extend around the entire perimeter of the core. Each channel path is shown with four coolant channels arranged end to end and separated by land areas 27 around the perimeter. Each coolant channel 25 has a coolant inlet 21*a* or 21*b* at one end and a coolant outlet 22*a* or 22*b* or 22*c* at the other end.

Coolant entering the coolant channel is cooler than that exiting the outlet. If the inlets of all coolant channels were adjacent each other, the region therearound would be much cooler than the region around the grouped outlets. This temperature gradient would not be conducive to uniform strip casting. This is solved by circumferentially staggering the inlets and outlets of adjacent channels. For example, as shown in FIG. 3, inlets 21*a* are staggered circumferentially from inlets 21*b* of adjacent channels. Similarly, outlets 22*a* are staggered circumferentially from outlets 22*b*, which are in turn staggered from outlets 22*c*. The inlets and outlets have been staggered by 45° from adjacent inlets and outlets. This means that the coolant channels along channel paths A and C have an identical orientation. Coolant channels B and D also have the same orientation, but are rotated 45° from the A/C orientation. In this preferred layout, inlets (such as 21*b*) are separated from the outlets (such as 22*b*) of the channels in the same channel path (B and D) by narrow land areas 27 and are located at about the midpoint of the adjacent coolant channels (in paths A and C). This provides a uniform pattern of cooling which produces very uniform cast products.

FIG. 6 shows a similar core in which the coolant channels are continous around the core perimeter. Several inlets and outlets supply and withdraw coolant from the channels. Preferably, there are an equal number of inlets and outlets and they alternate in the channels. They also are preferably paired with one another and separated by the same distance so that a uniform temperature pattern can be established. But except for the impetus caused by the rotation, the coolant in this alternative has no preference as to which outlet in the channel it exits. For this reason, the arrangement is less desirable than that of FIG. 3.

Figure 4:
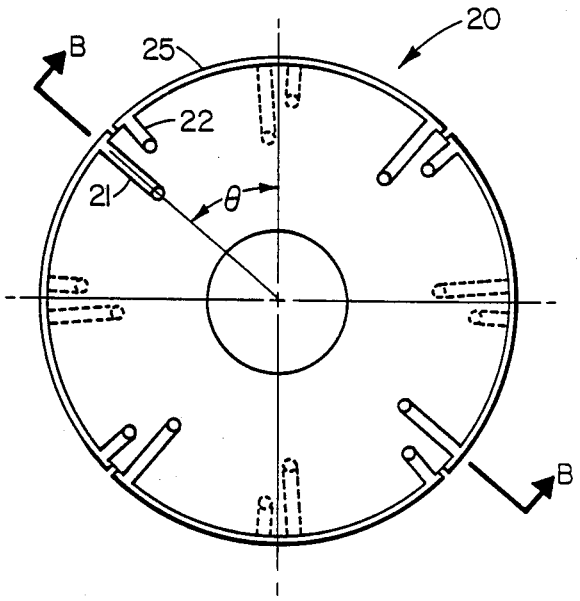
FIG. 4 is a section view taken from FIG. 3 showing the orientation of the coolant inlets and outlets.
Figure 5:
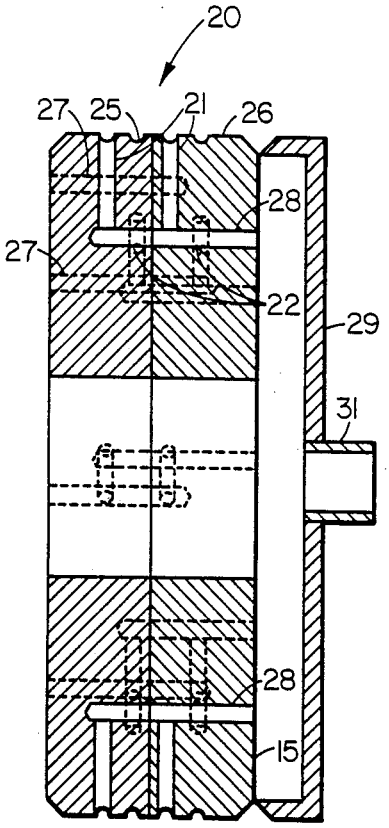
FIG. 5 is a section view taken from FIG. 4 and showing the internal coolant flow paths in the core body.

The inlets and outlets communicate with a source of coolant and a coolant dump through supply and return passages drilled in the core. As shown in FIGS. 4 and 5, coolant supply reservoir is defined by a cover 29 over one side 15 of the core. Pipe 31 supplies the coolant to the supply reservoir. Coolant from the supply reservoir flows through horizontal conduits 28 into the inlets 21 through the coolant channels 25 and out outlets 22. It then passes through horizontal return conduits 27 to a coolant dump (not shown) on the side opposite the supply reservoir. The dump may be formed like the supply reservoir with a cover over side 14 of the core.

The inlets are separated by an angular separation, $\theta$, in the case of FIG. 4 equal to 45°. If the distance between paired inlets and outlets in uniform, the outlets will also be separated by the same angle. It is preferred that the separation angle be at least about 5° or the mechanical strength of the core will be reduced to a dangerous level because of the numerous supply and return conduits.

The coolant channels are machined below the casting surface by any known means. It is convenient to have a core body covered with an annular shell. This allows the shell to be removed and replaced by another new casting surface without replacing the core. If the coolant channels are grooves machined in the core, the replacement of the shell saves labor in making new coolant channels. Of course, the grooves could be machined in the inside surface of the shell or both in the shell and the core body.

The present invention uses circumferential paths which take advantage of the centrifugal forces generated by the rotation of the drum to force the coolant into intimate contact with the casting surface. A slight choking of the outlets (eg. by making them slightly smaller than the inlets) is also useful for obtaining the intimate contact. As mentioned above, this contact mitigates the possible cavitation.

EXAMPLE 91 kg of copper alloy (Cu-Ni-Si) was cast in argon atmosphere on a chill wheel such as shown in FIG. 4. The tundish as shown in FIG. 1 was located on the wheel at about 45° from the vertical. The core and shell were steel. The outer casing surface was prepared with a 220 grit sander. Other parameters were as follows:

Substrate
- Diameter—34.5 cm
- Width—12 cm
- Speed—28–50 rpm (surface 30–55 m/min)

Coolant
- Flow Rate—300 l/min
- Inlet Temp—34° C.
- Outlet Temp—43° C.
- Pour Temp—1143° C.

A strip with good thickness uniformity was obtained. Over 5 positions along the 91.5 meter long strip, the thickness deviated from 1.0 mm to 1.2 mm. The strip did have some surface defects not apparently atributable to the casting surface temperature profile. Pinholes were also observed which may have been caused by burnout of dissolved water vapor into the melt from the tundish refractories.

We claim:

1. A liquid-cooled substrate for casting uniform metal products directly from a metal melt comprising (A) a cylindrical core body having multiple coolant inlets and outlets in the outer cylindrical surface thereof and also having supply passages communicating the inlets with a coolant source and return passages communicating the outlets with a coolant dump, and (B) an annular, heat-conductive casting shell having inside and outside cylindrical surfaces, the outside surface being a casting surface for the metal melt and the inside surface overlaying the core outer surface and cooperating therewith to define a plurality of adjacent coolant channels extending substantially circumferentially around the core outer surface, wherein each coolant channel communicates with at least one inlet and one outlet and wherein the inlets of each coolant channel are staggered circumferentially from the inlets of each adjacent coolant channel and the outlets of each coolant channel are staggered circumferentially from the outlets of each adjacent coolant channel.

2. The liquid-cooled substrate for casting uniform metal products directly from the metal melt as in claim 1 wherein the coolant channels comprise machined grooves in the casting shell enclosed by the outer surface of the core body.

3. The liquid-cooled substrate for casting uniform metal products directly from the metal melt as in claim 1 wherein the coolant channels comprise machined grooves in the outer surface of the core body enclosed by the inside surface of the casting shell.

4. The liquid-cooled substrate for casting uniform metal products directly from the metal melt as in claim 1 wherein the core additionally comprises an axle for rotation of the substrate and wherein the coolant source is a reservoir located around the axle on one side of the core and the coolant dump is a reservoir around the axle of the other side of the core.

5. The liquid-cooled substrate for casting uniform metal products directly from the metal melt as in claim 1 wherein each coolant channel extends continuously around the entire circumference of the core.

6. The liquid-cooled substrate for casting uniform metal products directly from the metal melt as in claim 5 wherein each coolant channel extending around the core communicates with more than one inlet and more than one outlet around the circumference.

7. The liquid-cooled substrate for casting uniform metal products directly from the metal melt as in claim 1 wherein each coolant channel extends only partially around the entire circumference of the core.

8. The liquid-cooled substrate for casting uniform metal products directly from the metal melt as in claim 7 wherein each coolant channel communicates with one inlet and one outlet.

9. The liquid-cooled substrate for casting uniform metal products directly from the metal melt as in claim 1 wherein each inlet is paired with one outlet.

10. The liquid-cooled substrate for casting uniform metal products directly from the metal melt as in claim 9 wherein the separation distance between each inlet and outlet in a pair is substantially equal.

11. The liquid-cooled substrate for casting uniform metal products directly from the metal melt as in claim 1 wherein each inlet is staggered from the inlet of each adjacent coolant channel by at least about 5° angular separation.

12. The liquid-cooled substrate for casting uniform metal products directly from the metal melt as in claim 11 wherein each outlet is staggered from the outlet of each adjacent coolant channel by at least about 5° angular separation.

13. A liquid-cooled substrate for casting uniform metal products directly from the melt comprising an cylindrical body having an outer circumferential casting surface and a plurality of coolant channels below the casting surface extending substantially circumferentially around the body and having at least one coolant inlet and one coolant outlet communicating with each coolant channel and also having supply passages communicating the inlets with a coolant source and return passages communicating the outlets with a coolant dump, wherein the inlets of each coolant channel are staggered circumferentially from the inlets of each adjacent channel and the outlets of each coolant channel are staggered circumferentially from the outlets of each adjacent channel.

* * * * *